United States Patent [19]

Naegeli

[11] 3,941,905

[45] Mar. 2, 1976

[54] METHOD OF CONTINUOUSLY IMPREGNATING A TEXTILE FIBER ARRANGEMENT WITH LIQUIDS

[75] Inventor: Werner Naegeli, Winterthur, Switzerland

[73] Assignee: Pavena AG, Basel, Switzerland

[22] Filed: Apr. 2, 1973

[21] Appl. No.: 347,350

Related U.S. Application Data

[63] Continuation of Ser. No. 187,965, Oct. 12, 1971, abandoned.

[52] U.S. Cl. ..... 427/240; 427/323; 427/428

[51] Int. Cl.[2] ..... B05C 1/08

[58] Field of Search .... 117/65.2, 66, 67, 68, 111 A, 117/111 H, 140, 139.5, 101, 102, 115; 427/240, 323, 428

[56] References Cited

UNITED STATES PATENTS

| | | | |
|---|---|---|---|
| 2,219,663 | 10/1940 | Schuster | 8/150 |
| 2,719,806 | 10/1965 | Notteeohm | 154/101 |
| 2,746,894 | 5/1956 | Orser et al. | 154/101 |
| 2,779,387 | 1/1957 | Schairer | 154/25 |
| 2,787,572 | 4/1957 | Schwartz | 154/101 |
| 2,834,704 | 5/1958 | Lawrence | 156/180 |
| 2,904,954 | 9/1959 | Houser | 57/157 |
| 3,168,414 | 2/1965 | Fleissner | 117/140 X |
| 3,339,357 | 9/1967 | Marzocchi et al. | 57/35 |
| 3,384,507 | 5/1968 | Godwin et al. | 117/140 X |
| 3,426,389 | 2/1969 | Naegeli | 19/66 |
| 3,432,889 | 3/1969 | Naegeli | 19/66 |
| 3,479,237 | 11/1969 | Bergh et al. | 156/11 |
| 3,733,216 | 5/1973 | Goldman et al. | 117/65.2 X |

*Primary Examiner*—Bernard D. Pianalto
*Attorney, Agent, or Firm*—Werner W. Kleeman

[57] ABSTRACT

A method of continuously introducing an impregnating liquid into a textile fiber arrangement, wherein the fiber arrangement is passed through a converging space formed by circumferential surfaces of a pair of discs and by lateral limiting walls for transforming the fiber arrangement into a fiber sliver, the liquid is supplied under pressure to the face sides of the discs, and a liquid film is formed on the face sides of the discs for supporting the discs by said liquid film. Further, the liquid is transported along the face sides of said discs to the circumferential surfaces into the converging space by rotating the discs, there is formed a coat of liquid surrounding the fiber arrangement passing through said converging space, and subsequently condensing the fiber sliver into a compact fiber sliver in an adjacent hydrodynamic pressure zone acting at all sides and pressing liquid into the fiber sliver in said pressure zone by passing the fiber sliver between the circumferential surfaces of the discs.

9 Claims, 2 Drawing Figures

METHOD OF CONTINUOUSLY IMPREGNATING A TEXTILE FIBER ARRANGEMENT WITH LIQUIDS

CROSS-REFERENCE TO RELATED CASE

This is a continuation of my commonly assigned, copending U.S. application Ser. No. 187,965, filed Oct. 12, 1971, and entitled "Method of Continuously Impregnating A Textile Fiber Sliver With Liquids" now abandoned.

BACKGROUND OF THE INVENTION

The present invention concerns a method of continuously introducing an impregnating liquid into a textile fiber arrangement.

The term "fiber arrangement" is to be understood as comprising natural as well as manmade staple fibers, such as produced as a continuous untwisted arrangement, e.g., as card sliver or drawframe sliver or as web at the delivery side of the drafting arrangement. This term also is understood to comprise bundles or strands of endless filaments.

The term "liquid," in the singular or plural, is to be understood to comprise water or solvents or any solutions, dispersions and emulsions of any materials (e.g., adhesives, dyestuffs etc.) in water and/or other solvents.

The term "impregnate" is to be understood to comprise the coating of the individual fibers or the individual filaments respectively of the fiber arrangement with a film of liquid as well as a homogeneous, fine droplet-type distribution of the liquid in the fiber arrangement or a combination of both.

From U.S. Pat. Nos. 3,323,176 and 3,426,389 methods and devices are known for treating a fiber arrangement with liquids by means of a pair of discs in which liquid is brought into a throughpassing fiber arrangement transformed into tubular shape via a coaxially arranged separate duct, and in an adjacent free zone the liquid is allowed to radially penetrate the fiber arrangement without hindrance. The fiber sliver thus imbued with liquid then passes through a room or space converging in the direction of the throughpassage fiber sliver and formed by a pair of discs and by lateral walls and finally is condensed into a compact fiber sliver in a hydrodynamic pressure zone acting omnidirectionally, i.e., at all sides of the fiber sliver with high specific pressure.

By means of such procedure homogeneous impregnating or liquid distribution respectively is achieved in the fiber sliver. However, this procedure has disadvantages. The converging space as well as the adjacent pressure zone are formed by the pair of discs and by lateral cover walls or plates arranged at the face sides or end faces of the pair of discs. In spite of careful design aimed at keeping the clearance between the disc face sides and the lateral cover walls as small as possible, frequent penetration of fibers cannot be avoided due to the extraordinary fineness of the fibers and thus the passing fibers jam between the discs and their cover walls. This effect is further intensified by the high specific pressure prevailing in the pressure zone. As the condensed fiber sliver leaves the cover walls so-called "moustaches" or fiber beards form and which consist of previously jammed fibers, which often causes disturbances in the operation. By further reducing the clearances between the faces of the pair of discs and the lateral cover walls temporary improvement is reached, but due to the excessively small clearance wear of the discs and/or the lateral walls is considerably increased and the condition described above of the fibers being caught is found anew. It also has been found that the total clearance between discs and lateral walls no longer is distributed evenly, if the smallest practically unavoidable imprecisions are present, i.e., a larger clearance prevails on one side of a disc than on the opposite side. Fiber jamming between the discs and their cover walls thus is further facilitated, and the achievement of a uniform condensation of the fiber mass in the pressure zone thus is highly questionable.

SUMMARY OF THE INVENTION

It thus is an object of the present invention to ensure disturbance-free operation by means of correctly guiding the stream of liquid and at the same time to produce a perfect fiber sliver.

It is a further object of the invention to provide precision in the position of the discs with respect to their cover walls by correctly guiding the stream of liquid and to avoid penetration of the extraordinarily fine fibers between the discs and the cover walls where they could jam.

Now the inventive method of continuously introducing an impregnating liquid into a textile fiber arrangement, comprises the steps of a. passing the fiber arrangement through a converging space or room formed by circumferential surfaces of a pair of discs and by lateral limiting walls for transforming the fiber arrangement into a fiber sliver;
b. supplying the liquid under pressure to face sides of the discs;
c. forming a liquid film on the face sides of the discs for supporting the discs by said liquid film;
d. transporting the liquid along the face sides of said discs to said circumferential surfaces into said converging space or room by rotating the discs;
e. forming a coat of liquid surrounding the fiber arrangement passing through said converging space or room; and
f. subsequently condensing the fiber sliver into a compact fiber sliver in an adjacent hydrodynamic pressure zone acting at all sides and pressing liquid into the fiber sliver in said pressure zone by passing the fiber sliver between the circumferential surfaces of said discs.

The liquid can be brought in or supplied at each disc face side under equal pressure. Furthermore, for forming equal supporting liquid films the liquid brought in at each disc face side under equal pressure can be subject to the same throttle effect. It also is possible to supply the liquid under a low initial pressure and to increase the pressure hydrodynamically in the quadrant of the fiber sliver input, which can be effected, e.g., during the distribution by forming a wedge of liquid.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Now it is thought useful in the disclosure of the method aspects of this development to provide a brief description of an exemplary embodiment of apparatus for the implementation of such method, and which apparatus has been disclosed more fully in my copending U.S. application Ser. No. 347,351, filed Apr, 2, 1973, U.S. Pat. No. 3,835,974, entitled "Apparatus For Impregnating Textile Fibers" which, in turn, is a continuation of my previously filed U.S. application Ser. No. 187,966, filed Oct. 12, 1971, to which reference may be readily had and the disclosure of which applications is hereby also incorporated by reference.

Figure 1:
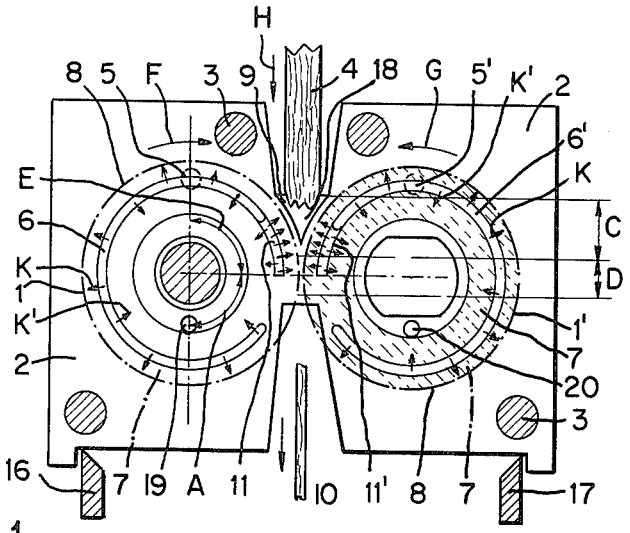
FIG. 1 is a cross-sectional view along the line I—I of FIG. 2 of an apparatus for continuously impregnating a fiber sliver with liquid.
Figure 2:
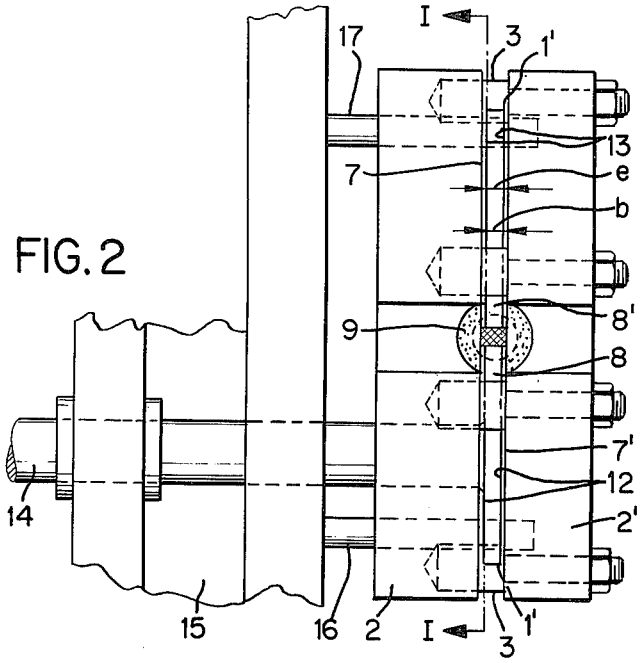
FIG. 2 is a top plan view of the apparatus of FIG. 1.

Hence by referring to FIGS. 1 and 2 it will be seen that such exemplary embodiments of apparatus consists of a pair of discs 1 and 1' each having face sides 12 and 13 respectively and circumferential surfaces 8 and 8', and wherein in FIG. 1. the latter have been merely indicated by broken lines, and limiting walls 2 and 2' laterally arranged adjacent to and covering the face sides 12 and 13 of the discs 1, 1'. The limiting walls 2 and 2' are mutually fixed at a distance *e* by spacer elements 3. The discs 1 and 1' are arranged axially parallely and with the circumferential surfaces 8 and 8' disposed opposite to each other. The disc 1 is rotatably supported and axially guided by a shaft 14 in a machine frame 15, with this disc 1 being axially movable, The disc 1' is also rotatably supported and arranged axially movably by means not shown in the drawing. The disc 1 can be driven by a suitable drive (not shown) to rotate in the direction indicated by arrow F. The disc 1' can rotate in the direction indicated by arrow G and can be subjected to a loading force under the influence of which the circumferential surface 8' is pressed against the circumferential surface 8 of the disc 1. Each disc 1 and 1' has a width *b* which is smaller than the distance *e*, the relation being approximately $e = b + 0.01$ mm to $e = b + 0.3$ mm corresponding to an impregnating liquid to be supplied as hereinafter described. For precise positioning in the plane of the discs 1 and 1' the limiting walls 2 and 2' are merely supported on two stops 16 and 17 which are connected to the machine frame 15. Within the clearance as indicated above, the discs 1 and 1' and the limiting walls 2 and 2' mutually retained at the distance *e* can be moved with respect to each other and thus can be brought into the same plane. The limiting walls 2 and 2' are provided with openings 5 and 5' formed as bores for introducing the impregnating liquid, these bores merging with liquid distributing grooves 6 and 6' respectively arranged in the region of, i.e., opposite to both face sides 12 and 13 of the discs 1 and 1' respectively. Surfaces 7, 7' of the limiting walls 2, 2' covered by the two face sides 12 and 13 of each disc 1, 1' only being shown for surface 7 in FIG. 1 are absolutely symmetrical in their surface areas as well as in the arrangement of the liquid distributing grooves 6 and 6' respectively One of these four surfaces 7, 7' is indicated in FIG. 1 hatched with broken lines for better clarity.

The circumferential surfaces 8, 8' and the lateral limiting walls 2, 2' define a converging room, space or zone 18 of a length C in an input quadrant E for transforming or consolidating an untwisted fiber arrangement 4 which is fed to the apparatus in the direction as indicated by arrow H into a fiber sliver by guiding at all sides. The circumferential surfaces 8, 8' and the lateral limiting walls 2, 2' also define a pressure zone of a length D which is arranged adjacent to the converging space or room 18 from which a compact fiber silver 10 is delivered in a delivery quadrant A. The term input quadrant and delivery quadrant respectively as employed herein, designate the quadrant of the circumferential surfaces 8, 8', each of which face the fiber sliver 4 and 10 entered in or delivered respectively from the apparatus.

As shown in FIG. 1, circular, converging recesses 11, 11' can be arranged in the input quadrant adjacent to the liquid distributing grooves 6, 6', said recesses 11, 11' preferably merging asymptotically towards the limiting walls in the directions F, G of rotation of the discs 1 and 1' respectively.

For continuously impregnating a fiber sliver 4, the material path of which is shown interrupted in FIG. 1 for clarifying the method, liquid is introduced on both sides of the pair of discs 1, 1' under equal, i.e., the same pressure via openings 5, 5' and the liquid distributing grooves 6, 6' and is forced to flow out in the directions as indicated by arrows K and K' along the lateral limiting walls 2, 2' and the face sides 12 and 13. Thus the clearance between the face sides 12 and 13 of the discs 1, 1' and the limiting planes of the limiting walls 2, 2' constantly remains filled with impregnating liquid. Owing to the supply of liquid to both face sides 12 and 13 under the same pressure and owing to the symmetry of the opposed pressure surfaces 7, 7' of the limiting walls 2, 2' the axially movable, i.e., shiftable discs 1, 1' adapt to equal liquid film thickness on both sides. Thus the pair of discs 1, 1' is automatically brought into or centered to a middle position with respect to the face side limiting walls 2, 2'. The liquid emerging along the limiting walls 2, is automatically adapted to the same throttle effect, or on both sides supporting liquid films of the same thickness $(e - b/2)$ are formed respectively for the discs 1 and 1'. These conditions prevail whether the pair of discs 1, 1' is at standstill or rotate. If the discs 1, 1' rotate in the direction of the arrows F and G respectively, impregnating liquid flows along the limiting walls 2, 2' in the direction of arrow K from the inside towards the circumferential surfaces 8 of the pair of discs 1, 1' and owing to the movement of the circumferential surfaces 8 is transported into the converging space or room 18, where it surrounds the fiber sliver 4 to be impregnated as a coat of liquid 9. Beginning in the converging space or room 18 and subsequently in the pressure zone D the impregnating liquid thus is pressed by the discs 1, 1' into the fiber sliver 4 which subsequently leaves the apparatus as an impregnated fiber sliver 10. A part of the liquid, brought in with an excess of the quantity needed for impregnating, can emerge laterally above the converging space 18, and is collected by means not shown in the drawing and is recycled into a liquid system provided for feeding liquid to the openings 5 and 5'. The liquid flowing from the liquid distribution grooves 6, 6' and the converging recesses 11, 11' respectively in the direction K' towards the inside of the faces sides 12, 13 is collected and drained via bores or openings 19 and 20 provided in the limiting walls 2, 2' and is also recycled into the liquid system by means not shown. By precisely separating the areas of the excessive liquid from the delivered impregnated fiber sliver 10, undesired re-moistening after the passage through the zones C and D is avoided, e.g., the grooves 6, 6' in the delivery quadrant A not being extended to the height of the pressure zone

D.

In several respects it has proven suitable to bring in or to supply the impregnating liquid under low initial pressure along the limiting walls 2 2' and to partially provide in the fiber sliver 4 passing through the input quadrant E of the circumferential surfaces 8, 8' a hydrodynamic pressure increase. For this purpose the converging recesses 11 and 11' are provided in the input quadrant E. Notwithstanding the low initial pressure the pressure in the liquid film (of a thickness of $(e - b/2)$ of 0.005 mm to approximately 0.15 mm) in the region C of the converging space 18 and of the adjacent pressure zone D can be increased in this manner to extremely high terminal values depending on the viscosity and the type of liquid used. Thus it is possible to create a pressure in the liquid film which can be equal to, or higher than, the specific pressure between the discs of the pair of discs 1, 1' in the pressure zone D, which latter can reach 200 kg/cm$^2$. In spite of the low initial pressure and of the high pressure in the pressure zone D sufficient liquid film on the face sides 12, 13 of the discs 1, 1' thus can be maintained. Also by using low initial pressures considerable simplification and less expensive design of the liquid transporting means are achieved.

According to the inventive method of continuously impregnating a fiber sliver the required impregnating liquid is supplied without any additional means to the appropriate place, i.e., to the converging room and in the form of a coat of liquid, and at the same time bringing in the liquid along the face side limiting walls effects the indispensable equalisation of the clearances and alignment of the planes of the discs 1, 1' and of the limiting walls 2, 2' which in view of the extraordinary fineness of the fiber material is a prerequisite for disturbance-free operation. If the input quadrant E of the fiber sliver an additional hydrodynamic pressure increase is effected in the impregnating liquid, any jamming of fibers between the discs and their covering walls is excluded and friction and wear are reduced to a minimum.

While there is shown and described present preferred embodiments of the invention, it to be distinctly understood that the invention is not limited thereto but may be otherwise variously embodied and practiced within the scope of the following claims. Accordingly,

What is claimed is:

1. A method of continuously introducing an impregnating liquid into an untwisted textile fiber arrangement, comprising the steps of:

a. passing the fiber arrangement through a converging space formed by circumferential surfaces of a pair of discs and by lateral limiting walls for consolidating the fiber arrangement into a fiber sliver;

b. supplying impregnating liquid under pressure through the lateral limiting walls into the clearance between the face sides of the discs and the lateral limiting walls;

c. aligning the planes of the discs and the lateral limiting walls with respect to each other by forming a liquid film between the face sides of the discs and the lateral limiting walls;

d. transporting the liquid along the face sides of said discs to said circumferential surfaces into said converging space by rotating the discs;

e. forming a coat of liquid surrounding the fiber arrangement passing through and consolidated in said converging space; and f. subsequently condensing the fiber sliver into a compact fiber sliver in an adjacent hydrodynamic pressure zone acting at all sides and pressing liquid into the fiber sliver in said pressure zone by passing the fiber sliver between the circumferential surfaces of said discs.

2. The method according to claim 1, wherein the liquid is supplied into said clearance under equal pressure at each face side of the discs.

3. The method according to claim 2, wherein the liquid supplied into said clearance under equal pressure for the formation of equal liquid films is subjected to an equal throttling effect.

4. The method according to claim 1, wherein the liquid is supplied into said clearance under a pressure which is lower than the pressure in said hydrodynamic pressure zone and the pressure is hydrodynamically increased in an input quadrant of said circumferential surfaces facing said fiber arrangement passing through said converging space.

5. The method according to claim 1, wherein the liquid flows from the inside of said face sides towards the circumferential surfaces of the discs.

6. The method according to claim 1, wherein the liquid prior to forming the liquid film is distributed in an area of said face sides and then is transported to surfaces of said limiting walls covered by said face sides.

7. The method according to claim 6, wherein the distribution is interrupted in a delivery quadrant of said circumferential surfaces facing said fiber sliver leaving said pressure zone.

8. The method according to claim 6, wherein during the distribution of the liquid the pressure is increased by the formation of a wedge of liquid.

9. A method of continuously introducing an impregnating liquid into an untwisted textile fiber arrangement comprising the steps of:

a. passing the fiber arrangement through a converging space formed by circumferential surfaces of a pair of discs and by lateral limiting walls for consolidating the fiber arrangement into a fiber sliver;

b. supplying impregnating liquid under pressure into the clearance between the face sides of the discs and the lateral limiting walls via openings of the lateral limiting walls;

c. aligning and supporting the discs between the lateral limiting walls by forming a liquid film of a thickness corresponding to the width of said clearance between the face sides of the discs and the lateral limiting walls;

d. transporting the liquid along the face sides of said discs to said circumferential surfaces into said converging space by rotating the discs;

e. forming a coat of liquid surrounding the fiber arrangement passing through said converging space; and f. subsequently condensing the fiber sliver into a compact fiber sliver in an adjacent hydrodynamic pressure zone acting at all sides and pressing liquid into the fiber sliver in said pressure zone by passing the fiber sliver between the circumferential surfaces of said discs.

* * * * *